US005632636A

United States Patent [19]

Maekawa

[11] Patent Number: 5,632,636

[45] Date of Patent: May 27, 1997

[54] TRANSMISSION DEVICE FOR AN IGNITION SYSTEM OF AN INTERNAL COMBUSTION ENGINE

[75] Inventor: Toshio Maekawa, Tokyo, Japan

[73] Assignee: Mitsubishi Denki Kabushiki Kaisha, Tokyo, Japan

[21] Appl. No.: 582,443

[22] Filed: Jan. 3, 1996

[30] Foreign Application Priority Data

Apr. 13, 1995 [JP] Japan ..... 7-088068

[51] Int. Cl.[6] ..... H01R 13/44

[52] U.S. Cl. ..... 439/125

[58] Field of Search ..... 439/125, 126, 439/127, 128, 281, 282

[56] References Cited

U.S. PATENT DOCUMENTS 4,621,881 11/1986 Johansson et al. .
5,324,207 6/1994 Itoh et al. .
5,406,242 4/1995 Klocinski et al. .
5,409,388 4/1995 Phillips, Jr. et al. .

FOREIGN PATENT DOCUMENTS 648580 1/1989 Japan .

*Primary Examiner*—Gary F. Paumen
*Assistant Examiner*—Christopher Goins
*Attorney, Agent, or Firm*—Sughrue, Mion, Zinn, Macpeak & Seas

[57] ABSTRACT

A transmission device for an ignition system of an internal combustion engine, which is equipped with a cylindrical terminal member made of an elastic material and having an inner circumference engagable with either one of an ignition coil or a spark plug. The cylindrical terminal member includes an engagement portion into which a terminal portion of an insulating member is fitted at its outer circumference, and the engagement portion has a thick-walled portion provided with an escape space to permit radial elastic deformation. This structure allows the elastic deformation of the thick-walled portion when the engagement of the terminal member is engaged with the spark plug or the ignition coil, thus facilitating engagement without excessive effort.

7 Claims, 6 Drawing Sheets

TRANSMISSION DEVICE FOR AN IGNITION SYSTEM OF AN INTERNAL COMBUSTION ENGINE

BACKGROUND OF THE INVENTION

1. Field of the Invention

The present invention relates to a transmission device for an ignition system of an internal combustion engine employed in automobiles or the like.

2. Description of the Prior Art

In general, ignition systems for internal combustion engines are made such that a high voltage output from an ignition coil is transferred through a transmission device to a spark plug.

FIG. 8 is a cross-sectional view showing a conventional direct plug-fitted transmission device for an ignition system of an internal combustion engine. In the figure, a cylinder head 1 is provided with a plug aperture 2. A spark plug 3 is screwed into a bottom portion of the plug hole 2. The spark plug 3 has an electrically conductive portion 3*a*.

An ignition system 4 of an internal combustion engine includes an ignition coil 5 and a transmission device 6. The transmission device 6 has an insulating coat 7 and a conductor 8. The insulating coat 7 is made of a silicone rubber which is an elastic insulating material. The insulating coat 7 has a cylindrical housing portion 7*a* that has a larger circumference at the spark plug 3 end and the end of which is formed into a thin-walled cylindrical portion 7*b*. A spring 11 is housed in the cylindrical housing portion 7*a*. The conductor 8 is turned out from a stiff round brass bar and covered with the insulating coat 7 thereby being insulated from the outside.

A plug-side elastic member 9 is provided with an inner cylindrical portion 9*b* having, at its center portion, a plug engaging aperture 9*a* in which the spark plug 3 is fitted. Further, the plug-side elastic member 9 is equipped with an outer cylindrical portion 9*d* located outside the inner cylindrical portion 9*b* with an engagement groove 9*c* being formed therebetween, and a reinforcing flange portion 9*e* formed at the top end portion of the outer cylindrical portion 9*d* as illustrated. These portions of the plug-side elastic member 9 are integrally formed using a silicone rubber with a given elasticity.

The thin-walled cylindrical portion 7*b* of the insulating coat 7 is inserted into the engagement groove 9*c* of the plug-side elastic member 9 so that a gap F exists between the inner circumference of the outer cylindrical portion 9*d* and the thin-walled cylindrical portion 7*b*, and a gap G exists between the outer circumference of the inner cylindrical portion 9*b* and the thin-walled cylindrical portion 7*b*. A silicone rubber-based adhesive agent 10 is packed in the gap F over the length L as illustrated. The adhesive length L is determined so that the plug-side elastic member 9 and the cylindrical housing portion 7*a* of the insulating coat 7 do not become disconnected from each other when the plug-side elastic member 9 is removed from the spark plug 3 by pulling on the insulating coat 7. Further, the adhesive agent 10 extends slightly above the flange portion 9*e* so that the cylindrical housing portion 7*a* and the outer cylindrical portion 9*d* thereby adhere to each other.

Furthermore, it is necessary to ensure that the conductor 8, the spring 11 and the electrically conductive portion 3*a* of the spark plug 3 are insulated from such grounded members as the cylinder head 1. To this end, the bonding adhesive agent 10 is packed so that a leakage gap does not remain between the outer circumference of the cylindrical housing portion 7*a* and the inner circumference of the outer cylindrical portion 9*d*. The cylindrical housing portion 7*a* is inserted into the engagement groove 9*c* after the adhesive agent 10 is applied onto its outer circumference over the length L. The spring 11 is formed by winding an elastic, conductive wire into a coil, and its upper end portion is then fixed to the conductor 8 to be electrically coupled thereto.

A coil-side elastic member 12 is made of an elastic polybutylene terephthalate (PBT). Further, although not illustrated, in the inside of the coil-side elastic member 12, one end portion of the conductor 8 is electrically connected with the high voltage side terminal of the ignition coil 5 and insulated from the outside. The transmission device 6 is composed of the insulating member 7, the conductor 8, the plug-side elastic member 9, the adhesive agent 10, the spring 11, and the coil-side elastic member 12.

In the transmission device 6 constructed as described above, the spark plug 3 is fitted into the plug engaging aperture 9*a* of the plug-side elastic member 9 with a given force, and the spring 11 is compressed to press the conductive portion 3*a* of the spark plug 3 to be electrically connected therewith.

The operation will now be described. A high voltage output from the ignition coil 5 travels from the conductor 8 through the spring 11 to the spark plug 3. The gap G present between the inner cylindrical portion 9*b* of the plug-side elastic member 9 and the thin-walled cylindrical portion 7*b* of the insulating coat 7 permits enlargement and deformation of the diameter of the inner cylindrical portion 9*b* when the spark plug 3 is fit into the plug-side elastic member 9, thus facilitating insertion and removal of the spark plug 3 into and from the plug-side elastic member 9.

A problem arises with such conventional transmission devices for ignition systems, however, in that a long adhesive range, i.e., adhesive length L, between the cylindrical housing portion 7*a* of the insulating coat 7 and the outer cylindrical portion 9*d* of the plug-side elastic member 9 is necessary, resulting in difficulties in achieving size-reduction, particularly the reduction of the axial dimension thereof, of the plug-side elastic member 9 made, for example, of an expensive silicone rubber. In addition, there is a possibility that the adhesive agent 10 could flow under the lower end portion of the thin-walled cylindrical portion 7*b* into the gap G between the inner cylindrical portion 9*b* of the plug-side elastic member 9 and the thin-walled cylindrical portion 7*b* of the insulating coat 7. If the adhesive agent 10 runs into the gap G and then hardens, difficulties are encountered in the enlargement and deformation of the inner diameter of the inner cylindrical portion 9*b*, so that more effort is required for the inserting it on or removing it from the spark plug 3, thus decreasing its workability. Accordingly, strict control of the application conditions and amount of the adhesive agent 10 is required.

SUMMARY OF THE INVENTION

The present invention has been achieved with a view toward solving the problems described above, and it is an object of the present invention to provide a small and low-priced transmission device for an ignition system of an internal combustion engine in which the connection with a spark plug or an ignition coil is relative easy and requires little effort.

To this end, according to an aspect of the present invention, there is provided a transmission device for an ignition system of an internal combustion engine, comprising: a conduction member for transmitting a high voltage for ignition generated by an ignition coil to a spark plug; an insulating member having a cylindrical terminal portion formed on its end portion, and covering the conductive member to insulate the conductive member from the outside; and a cylindrical terminal member made of an elastic material and having an inner circumference and an outer circumference, the inner circumference being made to be engaged with one of the ignition coil or the spark plug and further having a cylindrical engagement portion made to be engaged with the terminal portion of the insulating member at the outer circumference, the cylindrical engagement portion having a thick-wall portion provided with an escape space to permit radial elastic deformation.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

The embodiments according to the present invention will now be described with reference to the accompanying drawings.

FIRST EMBODIMENT

Figure 1:
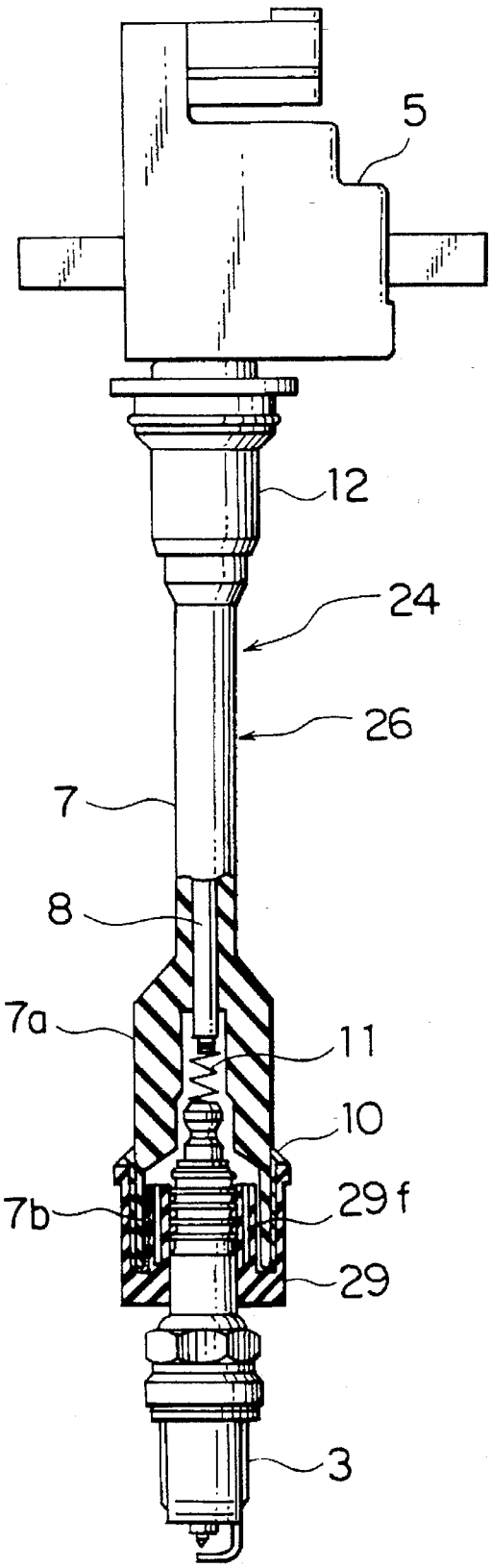
FIG. 1 is a partial cross-sectional view showing a transmission device for an ignition system of an internal combustion engine according to a First Embodiment of this invention.
Figure 2:
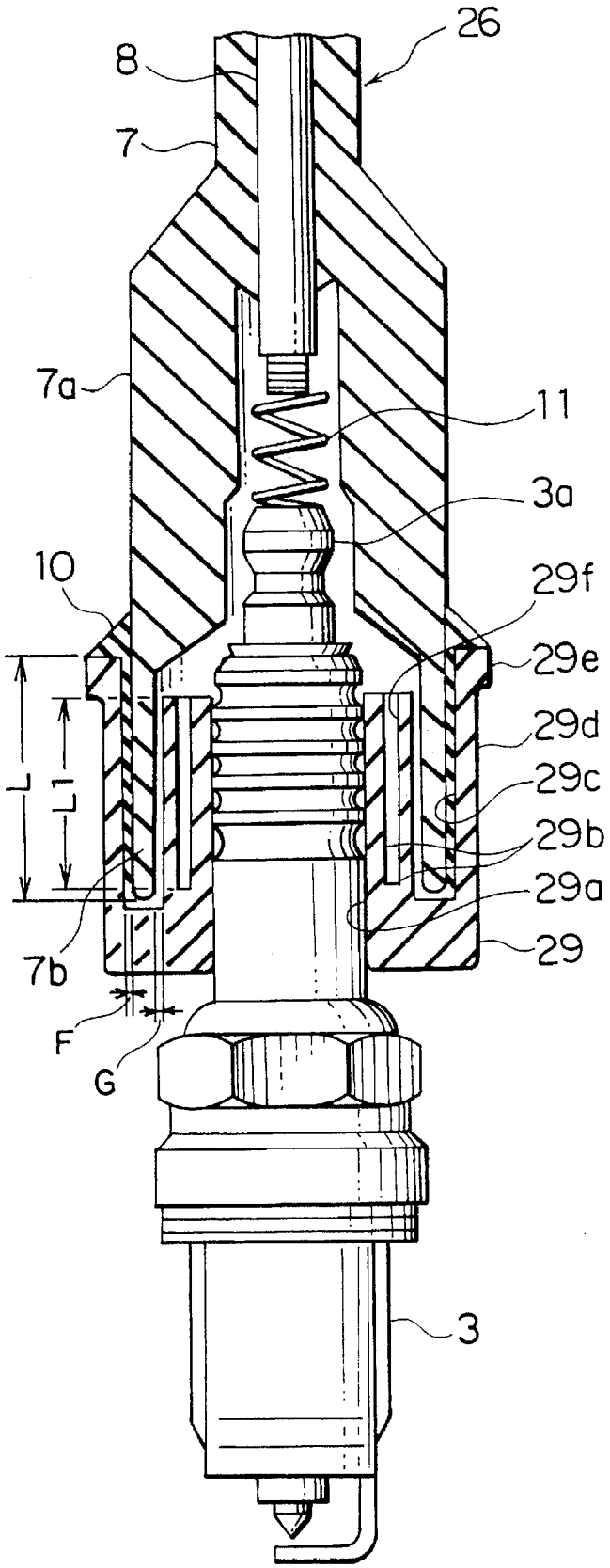
FIG. 2 is an enlarged cross-sectional view showing the essential portions of the transmission device according to the First Embodiment of this invention.
Figure 8:
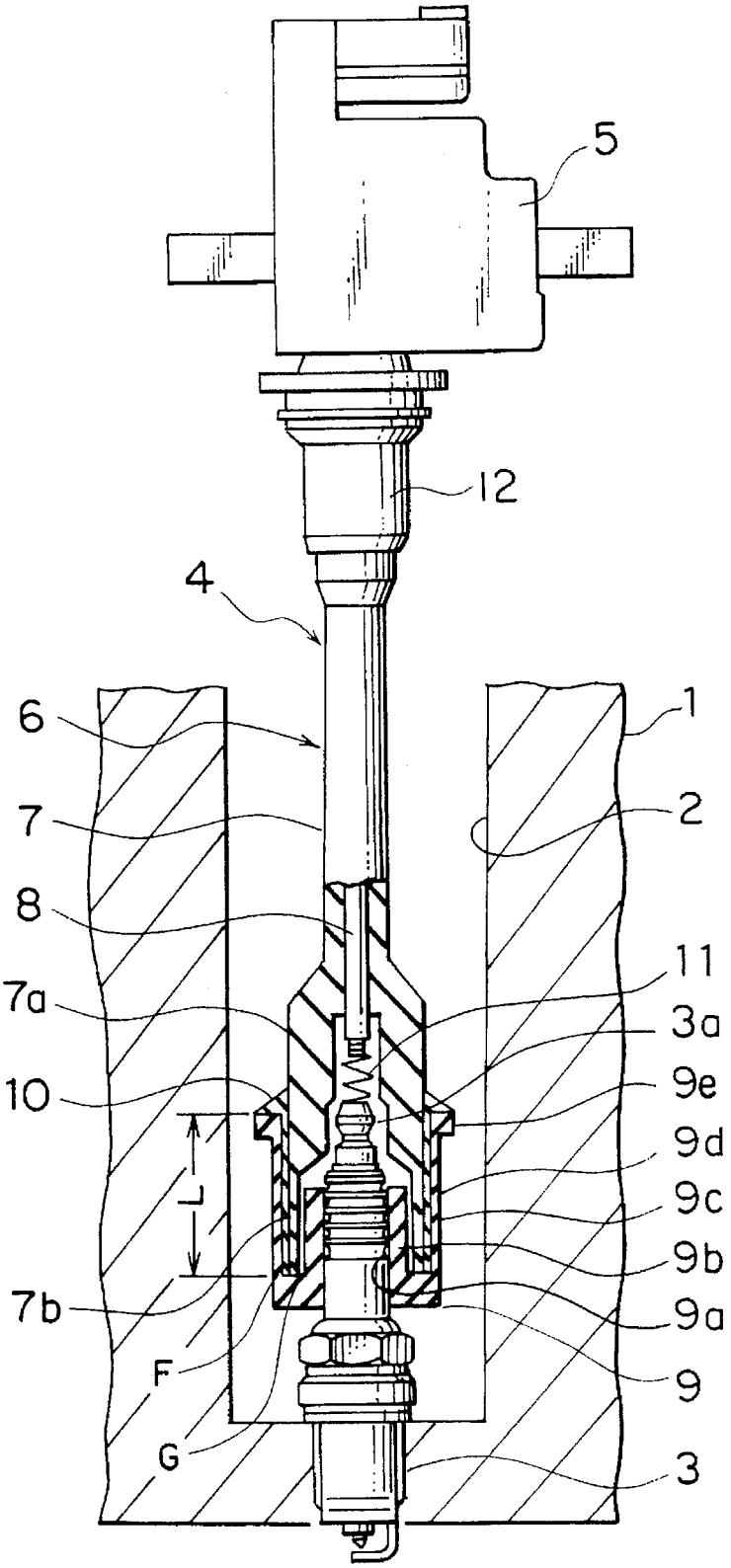
FIG. 8 PRIOR ART
FIG. 8 is a cross-sectional view showing an example of a conventional transmission device for an ignition system of an internal combustion engine.

FIG. 1 is a partial cross-sectional view showing a transmission device for an ignition system of an internal combustion engine according to a First Embodiment of this invention. FIG. 2 is an enlarged cross-sectional view showing the essential portion of the transmission device according to the First Embodiment. The parts which are the same as or corresponding to those shown in FIG. 8 will be given the same reference numerals.

In FIGS. 1, 2, an ignition system 24 of an internal combustion engine includes the ignition coil 5 and a transmission device 26. The insulating coat 7 is made of silicone rubber which is an elastic insulating material. The insulating coat 7 has a cylindrical housing portion 7*a* that has a larger circumference at the spark plug 3 end and the end of which is formed into the thin-walled cylindrical portion 7*b*. A spring 11 is housed in the cylindrical housing portion 7*a*. The conductor 8 is turned out from a round brass bar of a predetermined rigidity and covered with the insulating coat 7 thereby being insulated from the outside.

A plug-side elastic member 29 as a terminal member, provided with an inner cylindrical portion 29*b* which in turn, is a cylindrically shaped engagement portion having, at its central portion, a cylindrical plug engaging aperture 29*a* for housing the spark plug 3. Also included in the plug-side elastic member 29 are an outer cylindrical portion 29*d* which is provided outside of the inner cylindrical portion 29*b* so that an engagement groove 29*c* is formed between the inner cylindrical portion 29*b* and the outer cylindrical portion 29*d*, a disc-like reinforcing flange portion 29*e* located at the upper end portion of the outer cylindrical portion 29*d* as illustrated, and a ring-like clearance groove 29*f* which is an escape space formed in the thick-walled portion of the inner cylindrical portion 29*b* to be coaxial with the plug engaging aperture 29*a* and having a depth (longitudinal length) of L1. These parts of the plug-side elastic member 29 are integrally constructed by using a silicone rubber with a given elasticity.

The thin-walled cylindrical portion 7*b* of the insulating coat 7 is inserted into the engagement groove 29*c* of the plug-side elastic member 29 so that a gap F exists between the inner circumference of the outer cylindrical portion 29*d* and the thin-walled cylindrical portion 7*b*, and a gap G exists between the outer circumference of the inner cylindrical portion 29*b* and the thin-walled cylindrical portion 7*b*. The silicone rubber-based adhesive agent 10 is packed in the gap F over the length L as illustrated. The adhesive length L is determined so that the plug-side elastic member 29 and the cylindrical housing portion 7*a* of the insulating coat 7 do not become disconnected from each other when the plug-side elastic member 29 is removed from the spark plug 3 by pulling on the insulating coat 7. Further, the adhesive agent 10 extends slightly above the flange portion 29*e* so that the cylindrical housing portion 7*a* and the outer cylindrical portion 29*d* are thereby adhered to each other.

Furthermore, it is necessary to ensure that the conductor 8, the spring 11 and the electrically conductive portion 3*a* of the spark plug 3 are insulated from such grounded members as the cylinder head 1. To this end, the adhesive agent 10 is packed so that a leakage gap does not remain between the outer circumference of the cylindrical housing portion 7*a* and the inner circumference of the outer cylindrical portion 29*d*. The cylindrical housing portion 7*a* is inserted into the engagement groove 29*c* after the adhesive agent 10 is applied onto its outer circumference over the length L so that the excess adhesive projects a little beyond the end of flange portion 29*e*. The spring 11 is formed by winding an elastic, conductive wire into a coil, and its upper end portion is then fixed to the conductor 8 to be electrically coupled thereto.

A coil-side elastic member 12 is made of an elastic silicone rubber Further, although not illustrated, in the inside of the coil-side elastic member 12, one end portion of the conductor 8 is electrically connected with the high voltage side terminal of the ignition coil 5 and insulated from the outside. The transmission device 26 is composed of the insulating member 7, the conductor 8, the plug-side elastic member 29, the adhesive agent 10, the spring 11, and the coil-side elastic member 12.

In the transmission device 6 constructed as described above, one end portion of the conductor 8 is electrically connected with the ignition coil 5, and the spark plug 3 is fitted into the plug engaging aperture 29*a* of the plug side elastic member 29 with at a given tightness. Further, the spring 11 is compressed to press the conductive portion 3*a* of the spark plug 3 to be electrically connected therewith.

In the transmission device 26 thus constructed, in response to the spark plug 3 being fitted into the plug engaging aperture 29*a* of the plug-side elastic member 29, the ring-like clearance groove 29*f* of the plug-side elastic member 29 temporarily yields so that the plug engaging aperture 29*a* is easily enlarged or deformed. Accordingly, coupling therebetween is possible without requiring a stressing force. In addition, detachment of the spark plug 3 from the transmission device 26 (plug-side elastic member 29) can similarly be achieved.

Since a partition exists between the ring-like clearance groove 29*f* and the engagement groove 29*c* to which the adhesive agent 10 is applied, the ring-like clearance groove 29*f* dependably functions as an escape space as the adhesive agent 10 is inhibited from flowing into the ring-like clearance groove. In addition, even assuming that the adhesive agent 10 runs into the gap G present between the inner cylindrical portion 29*b* and the thin-walled cylindrical portion 7*b* of the insulating coat 7 and then hardens, the presence of the ring-like clearance groove 29*f* allows the plug engaging aperture 29*a* to be readily deformed. Therefor, the insertion or removal of the spark plug 3 can be accomplished using a little effort, thus facilitating the attachment and detachment operation. As a result, particularly strict control of the conditions for applying the adhesive agent 10 are not necessary. Moreover, since the ring-like clearance groove 29*f* serving as an escape space is formed to be coaxial with the inner circumference of the plug engaging aperture 29*a*, the die structure for the formation of the plug-side elastic member 29 can be simplified, which facilitates removal from the die and reduces manufacturing costs.

SECOND EMBODIMENT

Since the aforesaid plug-side elastic member 29 has the above structure, i.e., the ring-like clearance groove 29*f* in the inner cylindrical portion 29*b*, it is not always necessary to leave a space (gap G) between the outer circumference of the inner cylindrical portion 29*b* and the thin-walled cylindrical portion 7*b* of the insulating coat 7. Accordingly, the adhesive agent 10 can be packed in both the gaps F and G so that both the inner and outer circumferences of the thin-walled cylindrical portion 7*b* are adhered to the plug-side elastic member 29, thereby allowing the adhesive length L to be reduced by nearly half. This permits a reduction in size of the plug-side elastic member 29.

THIRD EMBODIMENT

Figure 3:
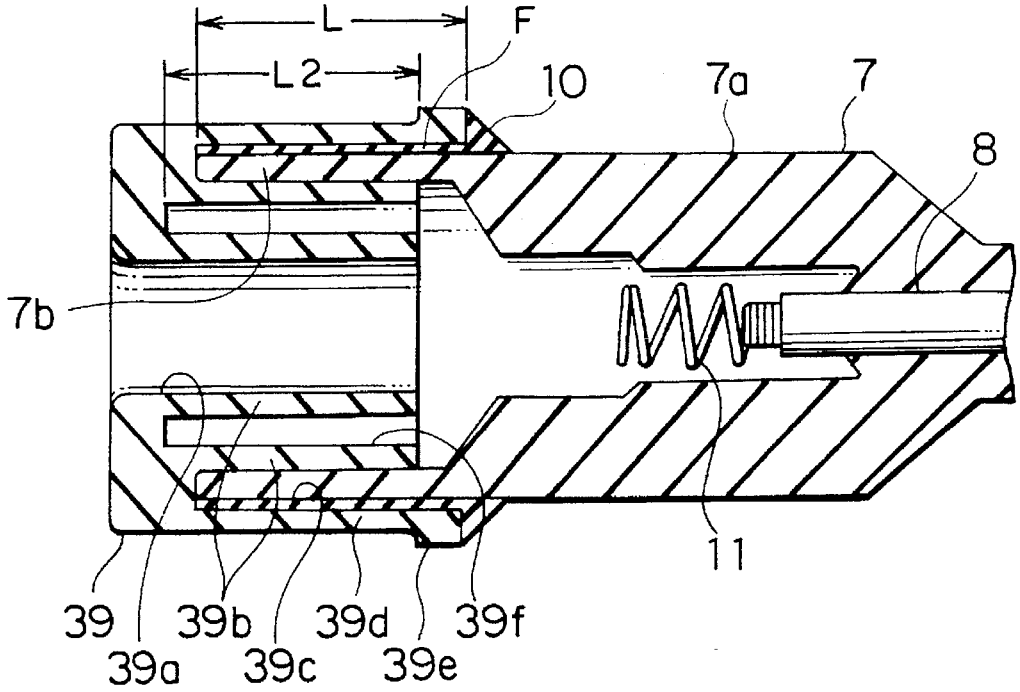
FIG. 3 is a cross-sectional view showing the essential portions of a transmission device according to a Third Embodiment of this invention.

FIG. 3 is a cross-sectional view showing the essential portions of a transmission device according to a Third Embodiment of this invention. In the figure, a plug-side elastic member 39 as a terminal member, provided with an inner cylindrical portion 39*b* which in turn, is a cylindrically shaped engagement portion having, at its central portion, a cylindrical plug engaging aperture 39*a* for housing a spark plug 3. Also included in the plug-side elastic member 39 are an outer cylindrical portion 39*d* which is provided outside of the inner cylindrical portion 39*b* so that an engagement groove 39*c* is formed between the inner cylindrical portion 39*b* and the outer cylindrical portion 39*d*, a disc-like reinforcing flange portion 39*e* located at the upper end portion of the outer cylindrical portion 39*d* as illustrated, and a ring-like clearance groove 39*f* is an escape space formed in the thick-walled portion of the inner cylindrical portion 39*b* to be coaxial with the plug engaging aperture 39*a* and having a depth (longitudinal length) of L2. These parts of the plug-side elastic member 39 are integrally constructed by a silicone rubber with a given elasticity.

The thin-walled cylindrical portion 7*b* of the insulating coat 7 is inserted into the engagement groove 39*c* of the plug-side elastic member 29 so that a gap F exists between the inner circumference of the outer cylindrical portion 29*d* and the thin-walled cylindrical portion 7*b*. The silicone rubber-based adhesive agent 10 is packed in the gap F over the length L as illustrated. The adhesive agent 10 is packed so that a leakage gap does not occur between the outer circumference of the cylindrical housing portion 7*a* and the inner circumference of the outer cylindrical portion 39*d* and so that it is insulated. The other constructions are the same as the First Embodiment shown in FIG. 2.

In other words, a feature of the Third Embodiment is that the bottom portion of a ring-like clearance groove 39*f* is positioned to be lower (formed to be axially deeper) than the lower end portion of the thin-walled cylindrical portion 7*b*. This arrangement allows the adjustment of the elastic formation. That is, as the axial relationship between the ring-like clearance groove 39*f* and the thin-walled cylindrical portion 7*b* is appropriately set, elastic deformation of the inner cylindrical portion 39*b* can be adjusted so that the coupling force of the plug-side elastic member 39 and the spark plug 3 can be optionally selected.

FOURTH EMBODIMENT

Figure 4:
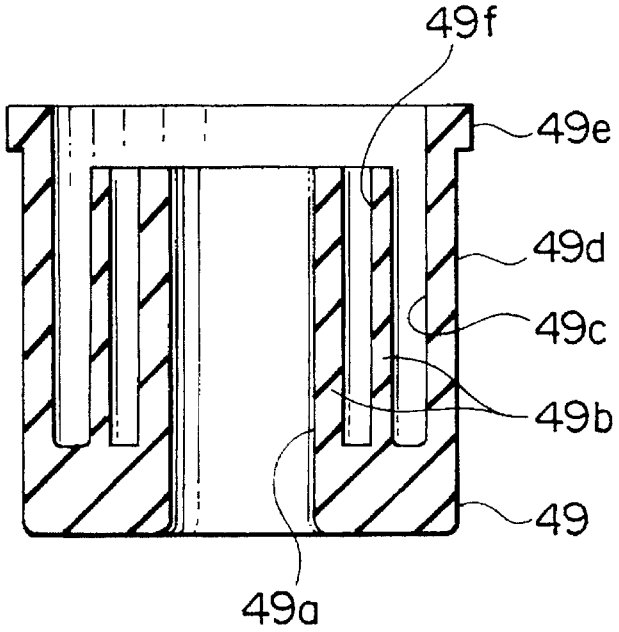
FIG. 4 is a cross-sectional view showing a plug-side elastic member of a transmission device according to a Fourth Embodiment of this invention.
Figure 5:
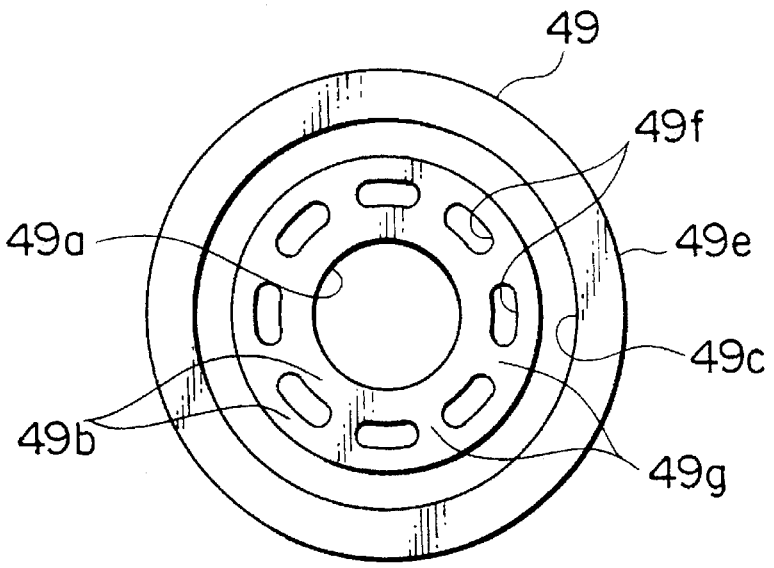
FIG. 5 is a plan view showing the same plug-side elastic member of the transmission device according to the Fourth Embodiment.

FIG. 4 is a cross-sectional view showing a plug-side elastic member of a transmission device according to a Fourth Embodiment of this invention. FIG. 5 is a plan view showing the same plug-side elastic member of the transmission device according to the Fourth Embodiment. In these figures, a plug-side elastic member 49 as a terminal member, provided with an inner cylindrical portion 49*b* which in turn, is a cylindrically shaped engagement portion having, at its central portion, a cylindrical plug engaging aperture 49*a* for housing a spark plug 3. Also included in the plug-side elastic member 49 are an outer cylindrical portion 49*d* which is provided outside of the inner cylindrical portion 49*b* so that an engagement groove 49*c* is formed between the inner cylindrical portion 49*b* and the outer cylindrical portion 49*d*, and a disc-like reinforcing flange portion 49*e* located at the upper end portion of the outer cylindrical portion 49*d*. Further, the plug-side elastic member 49 is provided with 8 columnar space portions 49*f*, i.e., 8 escape space portions each having a given depth and with an oval or athletic track like configuration, formed in the thick-walled portion of the inner cylindrical portion 49*b* and located circularly to be coaxial with a plug engaging aperture 49*a*, and further provided with coupling portion 49*g* for coupling the inner circumference side and outer circumference side of the inner cylindrical portion 49*b*. These parts of the plug-side elastic member 49 are integrally constructed by using a silicone rubber with a given elasticity.

The plug-side elastic member 49 is adhered through an adhesive agent to a cylindrical housing portion of an insulating coat in the same manner as the First Embodiment shown in FIG. 2.

In the plug-side elastic member 49 thus constructed, the inner circumference sides and outer circumference sides of the inner cylindrical portion 49*b* are coupled through the coupling portions 49*g*, with the result that the strength of the inner cylindrical portion 49*b* increases, thus improving durability.

FIFTH EMBODIMENT

Figure 6:
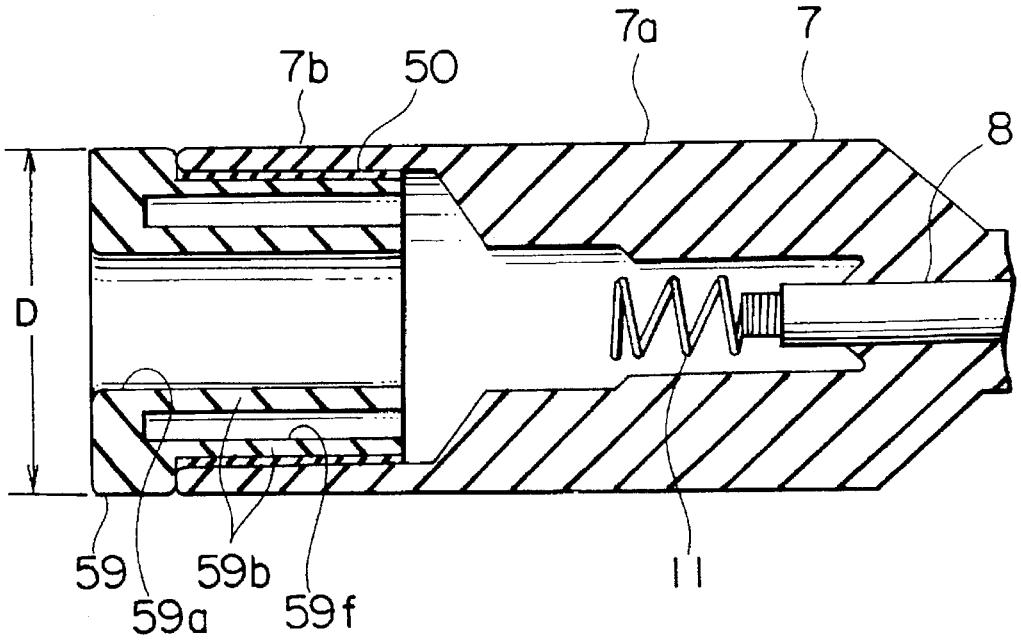
FIG. 6 is a cross-sectional view showing the essential portions of a transmission device according to a Fifth Embodiment of this invention.

FIG. 6 is a cross-sectional view showing the essential portions of a transmission device according to a Fifth Embodiment of this invention. A plug-side elastic member 59, as a terminal member, has an outer diameter of D which is the same as that of the thin-walled cylindrical portion 7*b* of an insulating coat 7. Since it is not always necessary to provide a space between the outer circumference of an inner cylindrical portion 59*b*, which is the cylindrical plug engaging portion of the plug-side elastic member 59, and the thin-walled cylindrical portion 7*b* of the insulating coat 7, the space-therebetween is adhered with a silicone rubber-based adhesive agent 50. Even in this case, for insulation, the adhesive agent 50 is packed so that a leakage gap is not generated between the inner circumference of the thin-walled cylindrical portion 7*b* and the outer circumference of the inner cylindrical portion 59*b*. The other structures are similar to those for the First Embodiment in FIG. 2.

The reduction of the outer diameter D of the plug-side elastic member 59 brings about size and cost reductions of the plug-side elastic member 59 made, for example, of an expensive silicone rubber.

SIXTH EMBODIMENT

Although, in the foregoing First Embodiment, a single ring-like clearance groove 29*f* is provided as an escape space in the plug-side elastic member 29, it is also possible that a plurality of ring-like clearance grooves are provided to be coaxially with each other.

SEVENTH EMBODIMENT

Figure 7:
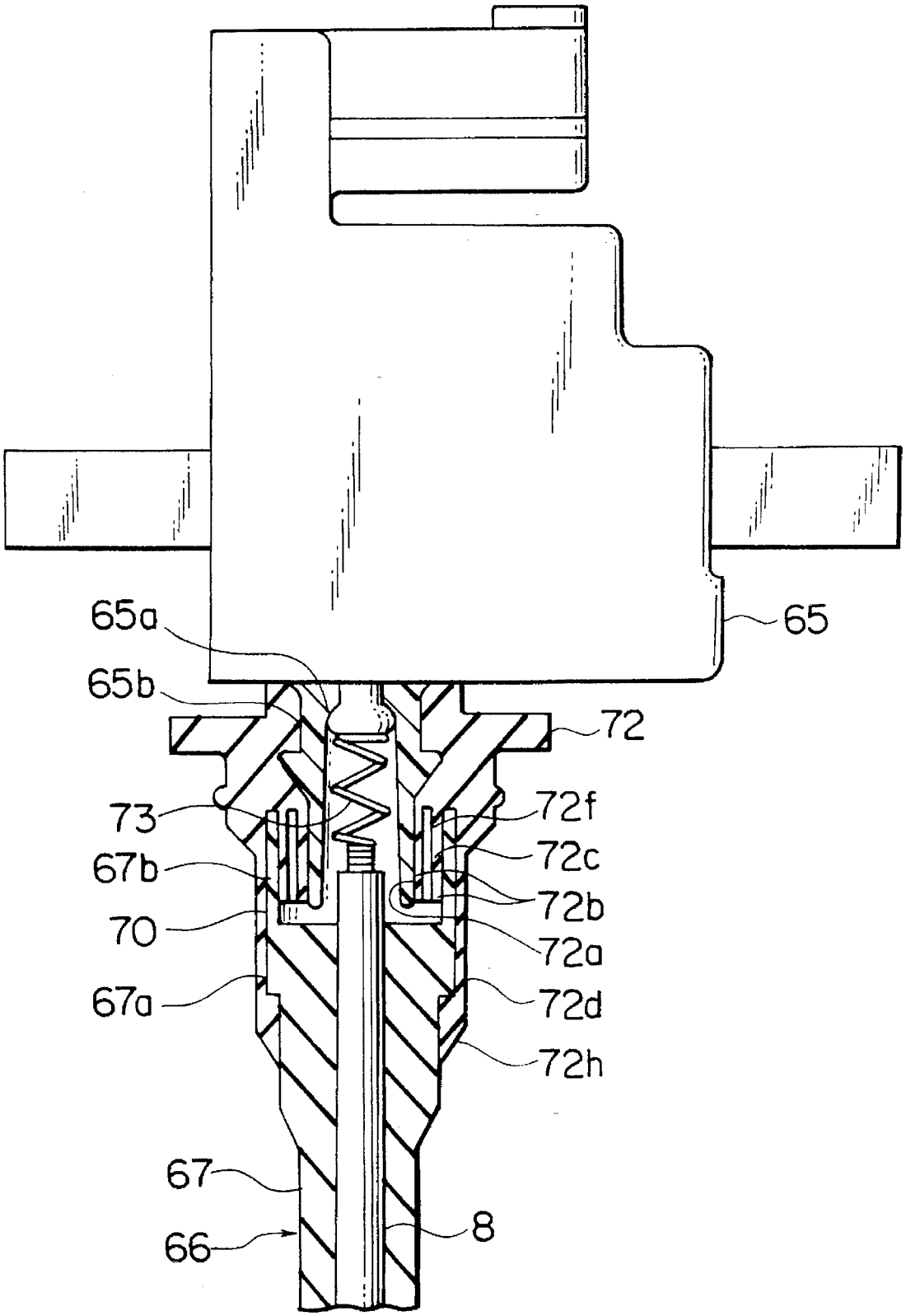
FIG. 7 is a cross-sectional view showing the essential portions of a transmission device according to a Seventh Embodiment of this invention.

FIG. 7 is a cross-sectional view showing the essential portions of a transmission device according to a Seventh Embodiment of this invention. In the figure, an ignition coil 65 is provided with a high voltage side terminal 65*a* for generating high voltage and a protruding portion 65*b* made of a PBT and surrounding the high voltage side terminal 65*a*. Further, a transmission device 66 is composed as follows. That is, an insulating coat 67 is made of a silicone rubber with a given elasticity. The end of the ignition coil 65 side of the insulating coat 67 is relatively large in dimension. A coil-side cylindrical housing portion 67*a* as a cylindrical terminal portion is provided on the end of the ignition coil 65 side of the insulating coat 67. The coil-side thin-walled cylindrical portion 67*b* is formed on the tip portion of the coil-side cylindrical housing portion 67*a*. Within the coil-side cylindrical housing portion 67*a* is housed a conduction spring 73 fixedly secured and electrically connected to one end portion of a conductor 8. Although not illustrated, the spark plug side of the insulating coat 67 has the same structure as that in the foregoing First Embodiment shown in FIG. 2, and is coupled to a similar plug-side elastic member.

A coil-side elastic member 72, which is a terminal member, is equipped with an inner cylindrical portion 72*b* which is a cylindrical engaging portion having, at its central portion, a cylindrical coil-receiving hole 72*a*. In addition, around the outside of the inner cylindrical portion 72*b* there is an outer cylindrical portion 72*d* so that an engagement groove 72*c* is formed with respect to the inner cylindrical portion 72*b*. Also included in the coil-side elastic member 72 are a step portion 72*h* and a ring-like clearance groove 72*f* which is an escape space portion formed in the thick-walled portion of the inner cylindrical portion 72*b* to be coaxial with the cylindrical coil-receiving hole 72*a*. These parts are integrally formed by a silicone rubber with a given elasticity.

The coil-side thin-walled cylindrical portion 67*b* of the insulating coat 67 is inserted into the engagement groove 72*c* of the coil-side elastic member 72. This coil-side thin-walled cylindrical portion 67*b* is adhered by a silicone rubber based adhesive agent 70 to the inner circumference of the outer cylindrical portion 72*d* and further to the outer circumference of the inner cylindrical portion 72*b*. At this time, the step portion 72*h* existing at the tip portion (lower end portion in the illustration) of the outer cylindrical portion 72*d* is engaged with the coil-side cylindrical housing portion 67*a*, making the coupling therebetween more firm. In this case too, a given adhesive range is used to inhibit the disconnection of the coil-side cylindrical housing portion 67*a* of the insulating coat 67 when the coil-side elastic member 72 is engaged with or removed from the protruding portion 65*b* of the ignition coil 65 by hand. This adhesion can ensure a firm connection between the coil-side cylindrical portion 67*a* and the coil-side elastic member 72.

It is necessary to ensure the insulation of the conductor 8, the spring 73 and the high voltage side terminal 65*a* of the spark coil 65 from such grounded members as the cylinder head 1. To this end, the adhesive agent 70 is packed so that no leakage gap remains between the outer circumference of the coil-side cylindrical housing portion 67*a* and the inner circumference of the outer cylindrical portion 72*d*. The coil-side cylindrical housing portion 67*a* is inserted into the engagement groove 72*c* after the adhesive agent 70 is first applied onto its outer circumference over a given axial length.

In the transmission device 66 thus constructed, the coil-receiving hole 72*a* of the coil-side elastic member 72 is engaged with the protruding portion 65*b* of the ignition coil 65. At this time, the existence of the ring-like clearance groove 72*f* allows for the easy deformation of the inner cylindrical portion 72*b*, which enlarges the coil-receiving hole 72*a* thereby facilitating the engagement therebetween without excessive effort.

EIGHTH EMBODIMENT

Although the plug-side elastic member is generally designed to be detachable from the spark plug, there is no need to remove the coil-side elastic member from the ignition coil. Accordingly, in the foregoing Seventh Embodiment, the ignition coil and the coil-side elastic member can be integrally adhered to each other. That is, it is also possible that an adhesive agent is applied to the outer circumference of the protruding portion 65*b* of the ignition coil 65, before the ignition coil 65 is engaged with the coil-side elastic member 72. This structure exhibits the same effects as those of the Seventh Embodiment.

It should be understood that the foregoing relates to only preferred embodiments of the present invention, and that it is intended to cover all changes and modifications of the embodiments of the invention herein used for the purposes of disclosure, which do not constitute departures from the spirit and scope of the invention. For example, although in the foregoing embodiments the cylindrical housing portion and the coil-side cylindrical housing portion have cylindrical configurations, this invention is not limited to these configurations, but can take different shapes such as square or other angular configurations. In addition, it is also appropriate that the tip portions of the thin-walled cylindrical portion, the coil-side thin-walled cylindrical portion and so on be cut into comb-like configurations, which facilitates the insertion of the plug-side elastic members into the engagement grooves and the insertion of the coil-side elastic members into the engagement grooves.

Furthermore, it is also possible to accomplish the connection between the outer circumference of the cylindrical housing portion of the insulating coat and the outer cylindrical portion of the plug-side elastic member by means other than adhesion with an adhesive agent, for example, by fusion.

Although in the foregoing embodiments the ignition coil is located above the spark plug and both are directly connected to each other electrically through the stiff conductor, it is also possible that they be indirectly connected through a distributor or high voltage cord. Moreover, it is also acceptable that the conductor and the insulating coat are flexible.

What is claimed is:

1. A transmission device for an ignition system of an internal combustion engine, comprising:

a) an electrical conduction member for transmitting a high voltage for ignition generated by an ignition coil to a spark plug;

b) an electrically insulating member having a cylindrical terminal portion formed on an end portion thereof, and covering said conductive member to insulate said conductive member from the outside; and c) a cylindrical terminal member made of an elastic material and having an inner circumference dimensioned to be closely and tightly engaged with one of said ignition coil and said spark plug, and further having a cylindrical engagement portion configured to be inserted in said terminal portion of said insulating member, said cylindrical engagement portion extending radially outwardly from said inner circumference and defining, intermediate a radial thickness thereof, an axially extending open space to accommodate a radially outwardly directed elastic deformation of said tubular portion during an engagement with or a disengagement from one of said ignition coil and said spark plug.

2. A transmission device as set forth in claim 1, wherein said terminal member has an integrally formed outer cylindrical portion which forms an engagement groove for receiving said cylindrical terminal portion of said insulating member, together with said outer circumference of said cylindrical engagement portion.

3. A transmission device as set forth in claim 2, wherein an adhesive agent is packed in between an outer circumference of said terminal portion of said insulating member and an inner circumference of said outer cylindrical portion, (and further) in between said inner circumference of said terminal member and said outer circumference of said engagement portion.

4. A transmission device as set forth in claim 2, wherein an axial length of said open space is longer than an axial length of said engagement groove.

5. A transmission device as set forth in claim 1, wherein said open space is a ring-like clearance groove coaxial with said inner circumference of said terminal member.

6. A transmission device as set forth in claim 1, wherein said open space compromises a plurality of columnar space portions each extending axially.

7. A transmission device as set forth in claim 1, wherein an outer diameter of said terminal member is smaller than an outer diameter of said terminal portion of said insulating member.

* * * * *